US008276934B2

(12) United States Patent
Lanez et al.

(10) Patent No.: US 8,276,934 B2
(45) Date of Patent: Oct. 2, 2012

(54) DEVICE FOR SECURING A FOOTWEAR TO A SLIDING BOARD

(75) Inventors: Raphaël Lanez, Cluses (FR); Alexandre Souillard, Cran-gevrier (FR)

(73) Assignee: Decathlon, Villeneuve d'Ascq (FR)

( * ) Notice: Subject to any disclaimer, the term of this patent is extended or adjusted under 35 U.S.C. 154(b) by 626 days.

(21) Appl. No.: 12/376,910

(22) PCT Filed: Aug. 9, 2007

(86) PCT No.: PCT/FR2007/051804

§ 371 (c)(1), (2), (4) Date: Mar. 30, 2009

(87) PCT Pub. No.: WO2008/020144

PCT Pub. Date: Feb. 21, 2008

(65) Prior Publication Data

US 2010/0176576 A1 Jul. 15, 2010

(30) Foreign Application Priority Data

Aug. 17, 2006 (FR) ..... 06 07355

(51) Int. Cl.
*A63C 9/00* (2006.01)
*A63C 9/04* (2006.01)

(52) U.S. Cl. ..... 280/611; 280/607; 280/617; 280/11.33; 280/14.22

(58) Field of Classification Search ..... 280/607, 280/611, 617, 11.33, 14.22
See application file for complete search history.

(56) References Cited

U.S. PATENT DOCUMENTS

| | | | | |
|---|---|---|---|---|
| 5,857,700 | A * | 1/1999 | Ross | 280/623 |
| 6,065,770 | A * | 5/2000 | Hansen et al. | 280/617 |
| 6,390,492 | B1 | 5/2002 | Bumgarner et al. | |
| 2005/0161911 | A1 | 7/2005 | Piva | |

FOREIGN PATENT DOCUMENTS

| | | |
|---|---|---|
| EP | 1 358 916 A1 | 11/2003 |
| FR | 2 751 238 A1 | 1/1998 |
| WO | WO 98/17521 | 4/1998 |

* cited by examiner

*Primary Examiner* — Hau Phan
*Assistant Examiner* — Bryan Evans
(74) *Attorney, Agent, or Firm* — Kenyon & Kenyon LLP

(57) ABSTRACT

The securing device, to be mounted on a ski-board, includes a main body with a support base for a sole, two lateral flanges, and an assembly for the attachment of the shoe to the main body, including: a protective element and first and second means for attaching the latter onto the first and the second flanges. The first means include two serrated straps, namely front and rear. The proximal end of at least one strap is mounted so that it pivots on the first flange. The distal ends mate with front and rear locking systems fixed onto the protective element, for adjusting the length of said straps. The second flange is fitted with front and rear attachment systems. The second means of attachment include a fixing handle, pierced with two holes, in which the attachment systems engage, and a closure system by which the handle is connected to the protective element.

12 Claims, 2 Drawing Sheets

DEVICE FOR SECURING A FOOTWEAR TO A SLIDING BOARD

This is a 371 national phase application of PCT/FR2007/051804 filed 9 Aug. 2007, claiming priority to French Patent Application No. 06/07355 filed 17 Aug. 2006, the contents of which are incorporated herein by reference.

FIELD OF THE INVENTION

The present invention concerns the field of board sports, whether on water or on snow, for the practise of which the user is standing on a ski-board. More particularly, it concerns a device that is designed to effect the attachment of the shoe of the user to the ski-board.

BACKGROUND OF THE INVENTION

For the practise of this sport, it is necessary that the shoe of the user should be held securely to the board in a given position, and with a given orientation that corresponds to the point of balance sought for optimal skiing. This is achieved, in a manner with which one is familiar, by the employment, for each shoe, of an intermediate securing device that is mounted on the board at a given position but with an orientation that can be adjusted, with said device acting as a receptacle for the shoe and possessing means that are used to lock the latter in position when it is positioned in said device.

For example, a disk is placed at the given position on the board, and at its base, the securing device includes a circular aperture into which the disk of the ski-board can be registered at an angular position which is determined in relation to the general direction of the board. One thus achieves a connection between the base and the board, the angle of which can be adjusted.

Document FR.2.751.238 describes a securing device to be mounted on a ski-board, for the attachment of a shoe to said board that includes a shell whose base is extended at the sides by lateral edges. This device includes two straps, intended respectively to hold the instep in one case and the forefoot at the toes in the other. Each strap is connected, by one of its two ends, to the lateral edge of the base, while the two other ends of the two straps are connected together by a connecting bar designed to mate with additional locking means placed in a fixed manner on the other lateral edge of the base. The use of this single connecting bar allows simultaneous tensioning of the two straps on the shoe by the use of a single locking action.

In one embodiment, the lateral edge includes a fixed pin on the outside, and the connecting bar is terminated at the front by an open fork designed to fit onto the fixed pin, which then constitutes a hinged bearing point for the connecting bar, in the manner of a lever for tensioning the straps until such time as another attaching element, formed toward the rear of the connecting bar, mates with a complementary latch mounted at the rear of the lateral edge, which can consist of notches created on the outer surface of the connecting bar, designed to mate with notches formed on a hinged locking element at the rear of the lateral edge. Thus, for the locking of a shoe in the securing device, the user must move the connecting bar from back to front so as to engage the fixed pin in the fork, and must then pivot the rear of the connecting bar about said pin until such time as the notches created on the outer surface of the connecting bar engage in the notches formed on the inner face of the latch. Said latch is fitted with elastic return means, so as to allow automatic locking of the connecting bar.

In a second embodiment, the connecting bar takes the form of a rod of circular section. Toward the front, the lateral edge of the base includes a blind hole that is calibrated to serve as a receptacle at the front end of the connecting bar and, toward the rear, an attachment device configured to serve as a means for fixing to the rear end of the connecting bar. The tensioning of the straps is achieved by virtue of an elbowed part, in the shape of a crank, on the connecting bar between its front and rear ends, with this tensioning being effected, after engagement of the front end in the through hole, and the rear end on the attachment device, by tilting the crank downwards.

In these two embodiments, each of the two straps is composed of two parts connected together by means for locking and adjusting the length. More precisely, the part that is immediately adjacent to the connecting bar is a piece of serrated strap, with its locking system.

Although it can be used to effect the locking of the two straps during a given operation that is suitable to be performed with one hand by the user, the embodiments recommended in document FR.2.751.238 is not fully satisfactory. In particular, the preliminary positioning of the front end of the connecting bar requires a high degree of accuracy and therefore concentration by the user, whether for fixing the fork onto the fixed pin of the lateral edge in the first example, or introduction of the front end of the rod into the through hole in the second example. In particular, there exists a significant risk of involuntary operation of the means for locking the rear of the connecting bar, due to the fact that they are located at the lateral edge and also on the outside of the shoe.

SUMMARY OF THE INVENTION

The objective targeted by the present invention is to propose a securing device to be mounted on a ski-board, for the attachment of a shoe to said board, which overcomes some or all of the aforementioned drawbacks.

In a manner with which we are familiar from document FR.2.751.238, this is a device that includes the following:

- a main body designed to receive the shoe, where said body includes a support base for the sole, with first and second lateral flanges and
- an assembly for attachment of the shoe to the main body, which includes:
  - a protective element, intended to press down onto the top of the shoe,
  - at least one first means for attaching the protective element onto the first lateral flange and
  - second means for attaching the protective element onto the second lateral flange.

In a manner that is characteristic, in accordance with the present invention, said at least first attachment means includes at least one serrated strap. The proximal end is mounted so that it pivots on the first lateral flange, and the distal end of said strap is designed to mate with at least one front and/or rear locking system fixed onto the protective element, for adjusting the positioning of the protective element. In addition, the second lateral flange is fitted with a front attachment system and a rear attachment system. Finally, the second means of attachment include firstly a fixing handle, which is pierced with a front hole and a rear hole, into which the two said front and rear attachment systems can respectively engage, and secondly a closure system by which the fixing handle is connected to the protective element.

Advantageously, and as described in the remainder of the application, the device includes two first means of attachment, front and rear, designed to mate with front and rear locking systems.

It should be noted that the terms outside and inside used in the remainder of the present document describe a position in relation to the outside or inside parts of the shoe. For example, for the right shoe, the term outside corresponds to the right side and the term inside refers to the left side. On the other hand, for the left shoe the term outside refers to the left side and the term inside is the right side.

The first lateral flange is preferably the outside flange and the second lateral flange is the inside flange.

Thus, the closure system that enables the user to lock the securing device is not located on the outside, and is therefore not liable to be operated inadvertently or by a blow from the side, said closure system being placed on the inside of the protective element, relative to the top of the shoe, as will appear more clearly on reading the description that follows of a detailed example. In addition, the adjustment for the length of the straps, allowing adjustment of the device according to the size of the shoe, is opposite to the means of attachment, which results in total independence of the two adjustments, with no risk of accidental operation.

It should also be noted that the two lateral flanges can be advantageously extended by a rear arch that joins them at the rear of the shoe, where said arch can be detached and raised above the top of the support base. Nevertheless, although the rear arch is detached structurally from the two lateral flanges, it must be considered that the first side of the rear arch forms part of the first lateral flange, and that the second side of the rear arch forms part of the second lateral flange.

According to an implementation variant, the proximal end of at least the rear serrated strap is mounted on the first lateral flange of the main body with a double pivot action, namely a first pivot action on an axis of rotation perpendicular to the plane of said lateral flange, and a second pivot action on an axis of rotation parallel to said plane. This double pivot action is used to achieve optimal application of the protective element onto the top of the shoe, irrespective of the configuration and the size of the latter.

According to one embodiment of this same variant, the double pivot action is achieved by virtue of a hinge whose two parts are articulated about a pin, the first part being fixed so as to pivot on the first lateral flange of the main body, and the second part being fixed onto the serrated strap.

In another implementation variant, the proximal end of at least the rear serrated strap is equipped with a cylinder that is mounted in a cavity formed in the main body at the outside lateral flange, so that it is able to pivot freely. In this case, this is a simple pivot action, whose axis of rotation corresponds to the general direction of the cylinder.

According to an implementation variant, the closure system, by which the fixing handle is connected to the protective element, is a connecting-rod system. After engaging the two front and rear attachment systems in the front and rear holes of the fixing handle, the user then only has to fold down the connecting-rod system onto the protective element in order to achieve the attachment of said protective element onto the main body.

According to an implementation variant, the device also includes a fold-down means, designed to trigger automatic fold-down of the protective element onto the top of the shoe, as a result of placing the shoe onto the main body. The objective targeted by this fold-down means is to reduce the number of operations to be performed by the user in order to position the device. When the user inserts his shoe into the main body, the protective element is necessarily moved clear of said main body, outside of the first lateral flange. By virtue of the fold-down means, the action of placing the shoe onto the main body triggers automatic fold-down of the protective element onto the top of the shoe, so that the user then only has to engage the two front and rear attachment systems into the front and rear holes, and to operate the closure system.

In one embodiment of the latter variant, the rear arch includes a fixed arch that extends the lateral flanges of the main body, and a heel cup that is mounted so that it pivots on the inside of the fixed arch. The fold-down means is composed of a flexible link that is fixed firstly to the protective element and secondly to the upper part of the heel cup, so that application of the rear of the sole of the shoe onto said to link results in pivoting the rear serrated strap and therefore folding down of the protective element.

BRIEF DESCRIPTION OF THE DRAWINGS

The present invention will be understood more clearly on reading the is description that follows of implementation examples of a securing device to be mounted on a snowboard, for the attachment of a shoe to said board, illustrated by the appended drawings in which.

DETAILED DESCRIPTION

The device described in this present document concerns the practise of sports in which the user is standing up on a ski-board, namely a board that allows him to move over a given surface, whether it be snow or water. This said fixing device is used to attach the shoe of the user to said ski-board.

Figure 1:
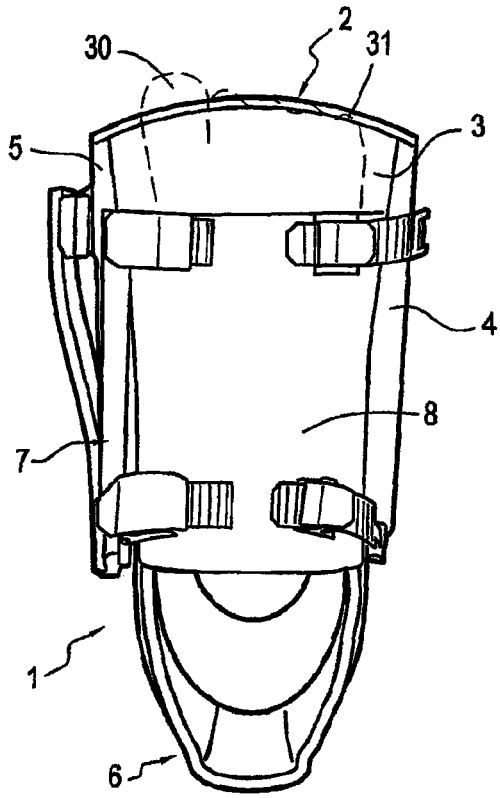
FIG. 1 is a schematic plan view of the device from above.

The securing device (1) that is illustrated in FIG. 1 to (3) includes a main body (2) that is designed to receive the shoe (not shown), and an attachment assembly (7) that is designed to allow the attachment of the shoe to said main body (2).

The main body (2) includes a support base (3) for the sole of the shoe, and two outside (4) and inside (5) lateral edges which, in this example, are extended by a rear arch (6). The two lateral flanges (4, 5) and the rear arch (6) are used for fixing the shoe onto the main body (2). Using broken lines and in a very schematic manner, FIG. 1 represents the position of the toes on the support base (3), so as to allow one to visualise what is meant by the terms "outside" and "inside", as used in this present description. More precisely, the device (1) illustrated in FIG. 1 is a device that is intended to receive the shoe of the right foot of the user, with the big toe (30) being close to the inside lateral flange (5) while the little toe (31) is close to the outside lateral flange (4).

The support base (3) is pierced with a circular aperture (32) that allows connection to the ski-board with a variable angular orientation, by virtue of a fixed disk on the top surface of said board.

In the example illustrated, the rear arch (6) is composed firstly of a fixed arch (22), extending the outside (4) and inside (5) lateral flanges of the main body (2), and secondly of a heel cup (23) that is mounted to pivot on the inside of the fixed arch (22). This heel cup, while providing stability for the rear of the foot and for the ankle, is used, by virtue of its ability to pivot, to assist the flexing movements of the leg in relation to the foot. The division of the rear arch (6) into a fixed arch (22) and in a pivoting cup (23) allows adjustment of the ability of said cup (23) to pivot, by having an adjustable abutment or limit system at the fixed arch (22).

The assembly (7) for attachment of the shoe to the main body (2) includes a protective element (8) that is intended to press down onto the top of the shoe, and means used to perform the attachment of this protective element (8) respectively onto the outside lateral flange (4) and the inside lateral flange (5) of the main body (2).

More precisely, the attachment assembly (7) includes two serrated straps, namely a front strap (9) and a rear strap (10), that are intended to connect the outside lateral flange (4) to the protective element (8) with the ability to adjust their length with a view to adjusting the positioning of the protective element (8) on the shoe, according to the configuration and the size of the latter.

The proximal ends (9*a*, 10*a*) of the two straps are mounted to pivot on the outside lateral flange (4), while their distal ends (9*b*, 10*b*) are designed to mate with front (11) and rear (12) locking systems fixed onto the outer surface of the protective element (8). Each locking system, which is known in its own right, when in the unfastened state, allows the serrated strap to slide up to a given position corresponding to the appropriate positioning of the protective element, and in the fastened state, to perform locking in said position by virtue of the interlocking of an end-stop in the notches of the strap.

Figure 3:
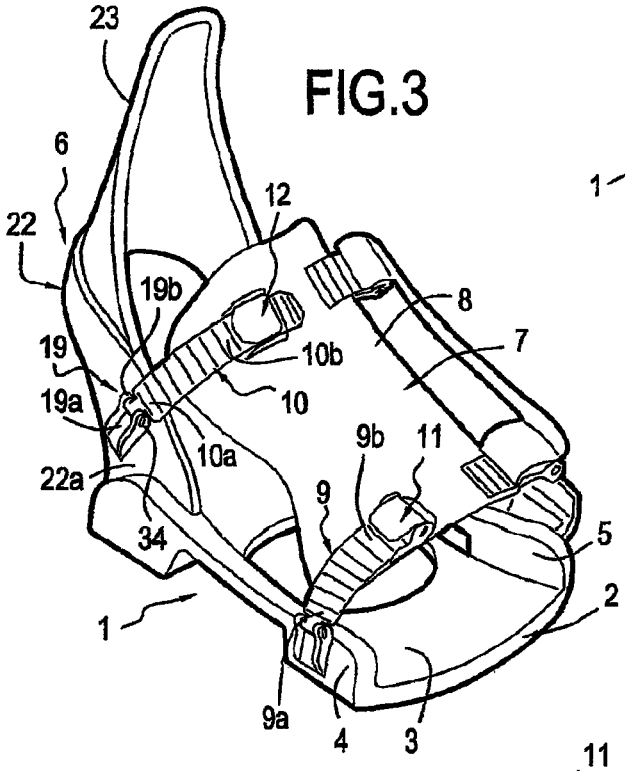
FIG. 3 is a schematic view in perspective of the device of FIG. 1 from the outside of the shoe and FIG. 4 is a schematic view in perspective, as seen from the inside of the shoe, more particularly illustrating the claw-type attachment system and the connecting-rod closure system.

In the example, as illustrated in FIG. 3, the proximal end (10*a*) of the rear strap (10) is fixed onto the outside part (22*a*) of the fixed arch (22). This fixing action, like that of the proximal end (9*a*) of the front strap (9) is achieved by a pivoting action, so as to allow perfect application of the protective element (8) onto the shoe, irrespective of the configuration and the size of the latter. In the example illustrated, this pivot action is achieved by virtue of a hinge (19) whose two parts are articulated about a pin (34). The first part (19*a*) of the hinge (19) is fixed so as to pivot on the outside part (22*a*) of the fixed arch (22), while the second part (19*b*) of the hinge (19) is fixed onto the proximal end (10*a*) of the strap (10). The use of such a hinge (19) allows one to achieve a double pivot action at the proximal end of the strap, namely a first pivot action on an axis of rotation that is perpendicular to the plane of the lateral flange (the fixing axis of the first part (19*a*)), and a second pivot action on an axis of rotation that is parallel to said plane (the axis of the pin).

This solution is not exclusive, however, and all the more so since the use of such a hinge (19) increases the cost of manufacture. Another embodiment, which is simpler and less expensive, consists of equipping the proximal end of at least the rear serrated strap (10) with a cylinder that is housed, clear of any pivot action, in a cavity formed in the main body at the outside lateral flange. The cylinder in question then forms the axis of rotation for the desired pivot action. Thus the cavity will be orientated either parallel to the plane of the lateral flange or perpendicular to the latter, according to the type of pivot action wanted.

For example, the cylinder will be orientated parallel to the plane of the outside lateral flange for the front strap, and perpendicular to the plane of the outside lateral flange for the rear strap.

The assembly (7) for attachment of the shoe to the main body (2) also includes a front attachment system and a rear attachment system connecting the protective element (8) to the inside lateral flange (5). These front and rear attachment systems are more particularly visible in FIG. 4). It consists of a front claw (13) and a rear claw (14) that are mounted on the inside lateral flange (5).

Mounted on the protective element (8) is a fixing handle (15) that works by means of a closure system (18). The fixing handle (15) is pierced with a front hole (16) and a rear hole (17) with a separation that corresponds to that of the front (13) and rear (14) claws, so that said claws (13, 14) can engage in the front (16) and rear (17) holes of the fixing handle (15).

The closure system (18) that connects the handle (15) to the protective element (8) is a connecting-rod system. More precisely, said system includes a front connecting-rod (35) and a rear connecting-rod (36) that are connected to each other by an actuating arm (37). Referring to the rear connecting-rod (36) in FIG. 4, at its proximal end, said connecting-rod (36) is connected to pivot on the protective element (8) according to a first axis of rotation (38). This same connecting-rod (36), at distance D from said axis (38), is connected so as to pivot on the handle (15) according to a second axis of rotation (39) which is parallel to the first (38). The actuating arm (37) is opposite to the fixing handle (15), as can be seen clearly in FIG. 4.

When the user inserts his shoe into the main body (2), by applying the sole onto the support base (3) and pressing back against the rear arch, he folds down the protective element (8) onto the shoe and positions the fixing handle (15) so as to allow engagement of the front (13) and rear (14) claws in the front (16) and rear (17) holes of said handle (15), with the connecting-rods (35, 36) being lifted in relation to the protective element (8), and the closure system (18) then being in the inactive position. It is then only necessary to fold down the operating bar (37) onto the protective element (8) in order to put the closure system (8) into the active position, with the slope of the connecting-rods (35, 36) applying traction to the fixing handle (15) and thus locking said handle (15) onto the inside lateral flange (5).

In this active position, the actuating arm (37) is substantially flat on the protective element (8).

Naturally, adjusting the length of the two serrated straps (9, 10) has been specified in order to achieve optimal locking of the fixing handle (15) during application of the operating bar (37) onto the protective element (8). If this locking action is not optimal, it is then best to again adjust the length of the straps (9, 10) by means of the locking systems (11, 12).

Figure 2:
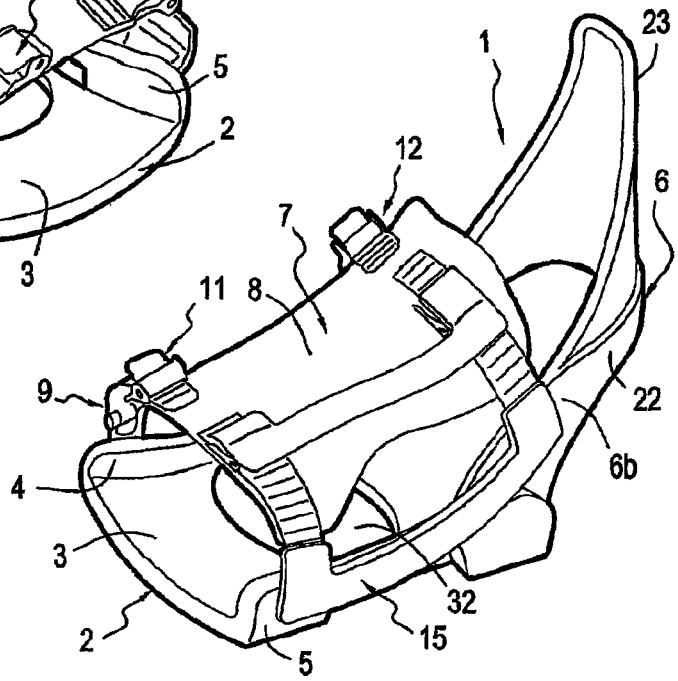
FIG. 2 is a schematic view in perspective of the device of FIG. 1, from the inside of the shoe.
Figure 4:
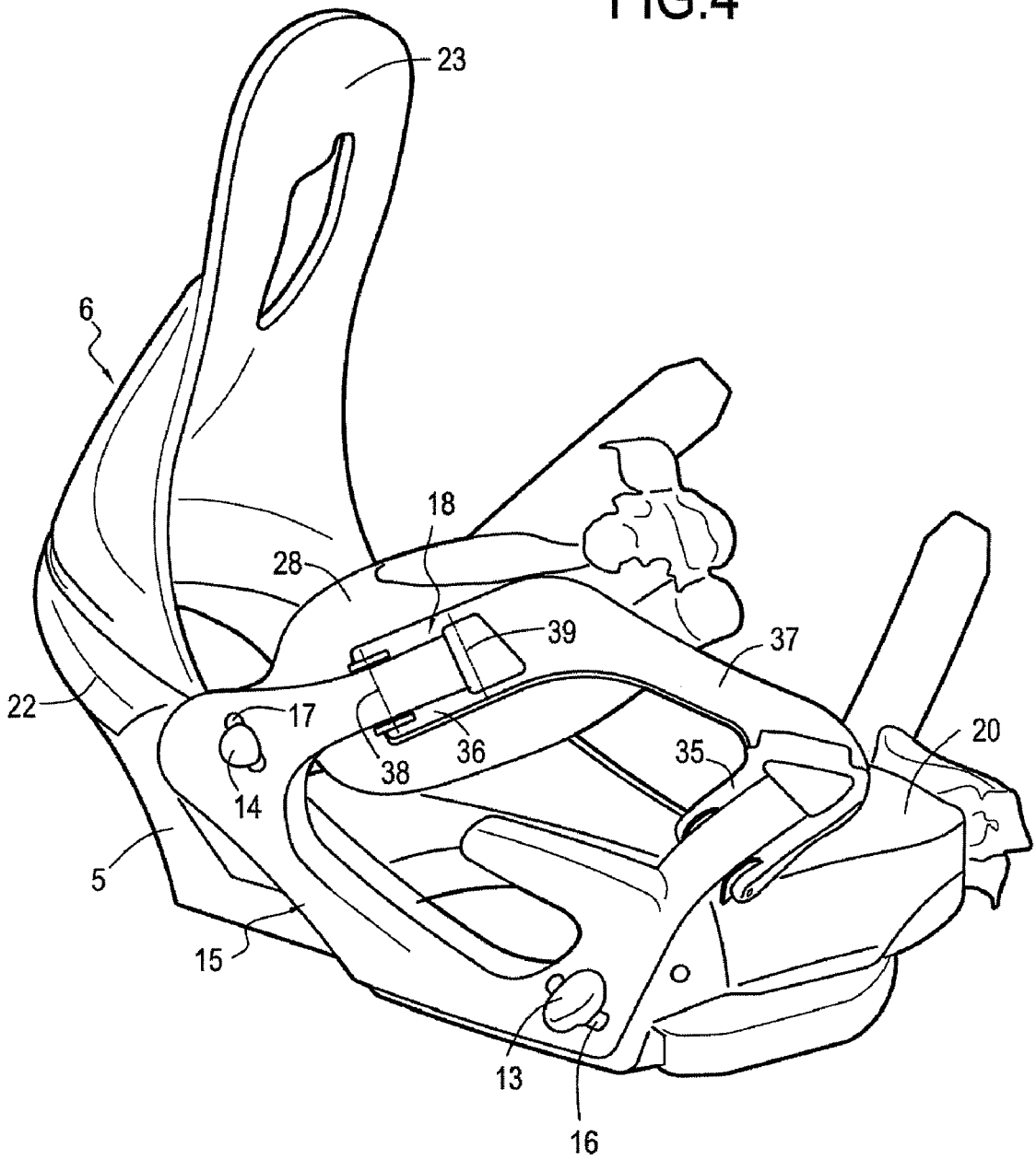

In the first example illustrated in FIGS. 1 to 3, the protective element (8) is in one piece, while in the second example illustrated in FIG. 4, the protective element (8) is composed of two separate parts, namely a front part intended to be applied onto the front of the shoe at the toes, and a rear part intended to be applied at the instep.

A variant that is not illustrated includes a means that is designed to trigger automatic fold-down of the protective element onto the top of the shoe as a result of positioning said shoe onto the main body. The fold-down means concerned in this example is a flexible link that is fixed firstly to the bottom face of the protective element and secondly to the upper part of the heel cup. The length and the placement of the flexible link are specified so that when the user places his shoe into the main body, then application of the rear of the sole of said shoe onto the flexible link triggers the pivoting action of the rear serrated strap and therefore the fold-down of the protective element.

It would be possible to achieve the same automatic fold-down effect of the protective element, as described above, by using a front hinge with a double pivot action, and by fixing the flexible link, firstly to the bottom face either of the second part of the front hinge or of the protective element, close to said front hinge, and secondly to the support base of the main body. In this case, it is the application of the front of the sole of the shoe onto said link that results in the pivot action of the pin of the front hinge, and therefore automatic fold-down of the protective element.

The present invention is not limited to the embodiment described above. In particular the serrated straps are mounted on the outside lateral flange, and the attachment systems on the inside lateral flange. Although it is preferred, this embodiment is not exclusive, and the positioning of the serrated straps and of the attachment systems can be reversed.

The invention claimed is:

1. A securing device, to be mounted on a ski-board, for the attachment of a shoe to said board, and that includes:

a. a main body designed to receive the shoe, said body including a support base for the sole, with first and second lateral flanges, said second lateral flange having a front part and a rear part, and b. an assembly to attach the shoe to the main body, said assembly including:

a protective element, intended to press down onto the top of the shoe, at least one first mechanism that attaches the protective element onto the first lateral flange, including at least one serrated strap whose proximal end is mounted so that it pivots on said first lateral flange, where said at least one first attachment mechanism is designed to mate with at least one front or rear locking system fixed onto the protective element to adjust the positioning of the protective element, a second mechanism that attaches the protective element onto the second lateral flange, including firstly a fixing handle, and secondly a closure system by which the fixing handle is connected to the protective element, with the front part of the second lateral flange comprising a front attachment system and the rear part of the second lateral flange comprising a rear attachment system, wherein the fixing handle is pierced with a front hole and a rear hole in which said front and rear attachment systems can respectively be engaged by folding the fixing handle down onto the shoe in order to attach the protective element onto the second lateral flange of the main body.

2. A device according to claim 1, wherein the device includes two first front and rear attachment parts designed to mate with front and rear locking systems.

3. A device according to claim 2, wherein the proximal end of at least the rear serrated strap is mounted on the first lateral flange of the main body with a double pivot action, said double pivot action comprising first pivot action on an axis of rotation perpendicular to the plane of said lateral flange, and a second pivot action on an axis of rotation parallel to said plane.

4. A device according to claim 3, wherein the double pivot action is achieved by virtue of a hinge whose two parts are articulated about a pin, with the first part being fixed so as to pivot on the first lateral flange of the main body, and the second part being fixed onto the serrated strap.

5. A device according to claim 3, wherein the proximal end of at least the rear serrated strap is equipped with a cylinder, mounted in a cavity formed in the main body at the first lateral flange.

6. A device according to claim 1, wherein the closure system, by which the fixing handle is connected to the protective element, is a connecting-rod system composed of a front connecting-rod and a rear connecting-rod, which are connected to each other by an operating bar located opposite to the fixing handle, so that the folding down of the operating bar onto the protective element results in the tilting of the connecting-rods, which triggers traction on the fixing handle so as to lock the handle onto the second lateral flange.

7. A device according to claim 1, wherein the device also includes a fold-down portion, designed to trigger automatic fold-down of the protective element onto the top of the shoe as a result of positioning the shoe on the main body.

8. A device according to claim 7, wherein the first and the second lateral flanges are extended by a rear arch, said rear arch including a fixed arch that extends the lateral flanges of the main body, and a heel cup that is mounted so that it pivots on the inside of the fixed arch and the fold-down portion is composed of a flexible link that is fixed firstly to the protective element and secondly to the upper part of the heel cup, so that application of the rear of the sole of the shoe onto said link, or application of the upper of the shoe or the lower calf onto the heel cup, operates the link and results in folding down of the protective element.

9. A device according to claim 1, wherein the first lateral flange is the outside flange, and the second lateral flange is the inside flange.

10. A device according to claim 1, wherein the fixing handle extends between the front part and the rear part of the second lateral flange when front and rear attachment systems are engaged within front and rear holes.

11. A securing device, to be mounted on a ski-board, for the attachment of a shoe to said board, and that includes:

a. a main body designed to receive the shoe, said body including a support base for the sole, with a first and a second lateral flanges, said second lateral flange having a front part and a rear part, and b. an assembly to attach the shoe to the main body, said assembly including:

a protective element, intended to press down onto the top of the shoe, at least one first mechanism that attaches the protective element onto the first lateral flange, including at least one serrated strap whose proximal end is mounted so that it pivots on said first lateral flange, where said at least one first attachment mechanism is designed to mate with at least one front or rear locking system fixed onto the protective element to adjust the positioning of the protective element, a second mechanism that attaches the protective element onto the second lateral flange, including firstly a fixing handle, and secondly a closure system by which the fixing handle is connected to the protective element, with the front part of the second lateral flange comprising a front attachment system and the rear part of the second lateral flange comprising a rear attachment system, wherein the fixing handle is pierced with a front hole and a rear hole in which said front and rear attachment systems can respectively be engaged by folding the fixing handle down onto the shoe in order to attach the protective element onto the second lateral flange of the main body, and wherein the closure system is a connecting-rod system composed of a front connecting-rod and a rear connecting-rod, which are connected to each other by an operating bar located opposite to the fixing handle, so that the folding down of the operating bar onto the protective element results in the tilting of the connecting-rods, which triggers traction on the fixing handle so as to lock the handle onto the second lateral flange.

12. A device according to claim 11, wherein the fixing handle extends between the front part and the rear part of the second lateral flange when front and rear attachment systems are engaged within front and rear holes.

* * * * *